US006536326B2

(12) United States Patent
Unger et al.

(10) Patent No.: US 6,536,326 B2
(45) Date of Patent: Mar. 25, 2003

(54) CONTROL SYSTEM AND METHOD FOR PREVENTING DESTRUCTIVE COLLISIONS IN FREE PISTON MACHINES

(75) Inventors: Reuven Z. Unger, Athens, OH (US); Nicholas R. van der Walt, San Diego, CA (US); Douglas E. Keiter, Athens, OH (US)

(73) Assignee: Sunpower, Inc., Athens, OH (US)

( * ) Notice: Subject to any disclaimer, the term of this patent is extended or adjusted under 35 U.S.C. 154(b) by 62 days.

(21) Appl. No.: 09/883,003

(22) Filed: Jun. 15, 2001

(65) Prior Publication Data

US 2002/0189433 A1 Dec. 19, 2002

(51) Int. Cl.[7] ..... F15B 13/16

(52) U.S. Cl. ..... 91/361; 92/60.5

(58) Field of Search ..... 92/60.5; 91/361

(56) References Cited

U.S. PATENT DOCUMENTS

| | | | | |
|---|---|---|---|---|
| 5,342,176 A | | 8/1994 | Redlich | |
| 5,385,021 A | | 1/1995 | Beale | |
| 5,502,968 A | | 4/1996 | Beale | |
| 5,615,556 A | * | 4/1997 | Honda et al. | 60/520 |

* cited by examiner

*Primary Examiner*—Edward K. Look
*Assistant Examiner*—Michael Leslie

(57) ABSTRACT

In a free piston machine, initial collisions of the piston with structures at the end of the cylinder are detected and generate a change in the magnitude of a perturbation signal, which is applied to the summing junction of a closed loop feedback control system controlling a piston force. The change is applied in a direction to reduce piston amplitude. In embodiments in which maximization of piston amplitude is desirable, the magnitude of the perturbation signal is also varied in the opposite direction in the absence of collisions to increase piston amplitude of oscillation so that operation then hunts between initial nondestructive collisions and a non-colliding maximum amplitude of piston oscillation.

20 Claims, 7 Drawing Sheets

CONTROL SYSTEM AND METHOD FOR PREVENTING DESTRUCTIVE COLLISIONS IN FREE PISTON MACHINES

BACKGROUND OF THE INVENTION

1. Field of the Invention

This invention relates generally to feedback control systems for controlling a free piston machine, and more particularly relates to apparatus and methods which are added to such control systems for the purpose of avoiding damaging collisions between the free piston and cylinder end structures, such as a cylinder head, against which the piston would, under some operating conditions, collide.

2. Description of the Related Art

Many types of machines utilize expansible chamber devices, such as a piston reciprocating in a cylinder, for operating upon gases. For example, they are used for pumping, compressing or displacing gases. Predominantly, pistons oscillate in linear reciprocation within a cylinder by means of a direct mechanical connection or linkage between a driver or a load and the piston. The linkage drives or is driven by the piston along a confined path of reciprocation and most commonly is a crankshaft and connecting rod system.

However, for some applications, such as high compression ratio compressors, free piston cryocoolers and free piston Stirling engines driving alternators, there are advantages to a free piston machine for such purposes. The piston is free because no mechanical linkage confines the piston to a fixed path of reciprocation. For example, a free piston may be driven by a linear, electric motor or a free piston Stirling engine. Typically, in order to maximize the efficient use of available drive power, free piston machines are driven at their frequency of mechanical resonance. Because the pistons are unconfined, the amplitude of reciprocation, may vary under the influence of changing operating conditions. Consequently, the piston, as well as any reciprocating structures attached to it, can collide at either end of the piston stroke with physical structures at the end of or beyond the cylinder.

In such freely reciprocating machines, the amplitude and frequency of reciprocation are a function of inertia, damping, and spring and driving forces. Therefore, these machines share the common feature that, when they are overdriven or underdamped, the reciprocating parts can acquire an amplitude of reciprocation that exceeds the internal geometrical limits of the space available for the motion of the reciprocating parts. If the amplitude of reciprocation is allowed to increase indefinently, the reciprocating parts will eventually collide repeatedly at the frequency of operation with stationary structures, or even with other reciprocating parts.

In free piston machines, it is always desirable to avoid collisions which have sufficient impact to damage the machine. However, under some operating conditions it is often desirable to maximize piston amplitude or stroke in order to maximize machine performance. Consequently, it is often desirable to operate the machine at the maximum amplitude which the machine can tolerate without damage to the machine. This requires accurate control of piston amplitude and rapid response to any changes in it.

A common practice in prior art free piston machines is to control one or more of the machine parameters, which affect or are affected by the forces applied by or to the piston, such as piston drive, by means of a conventional, closed-loop, negative feedback, control system. Such systems can be either analog or digitally controlled systems. Because piston amplitude is a function of piston forces, these systems exert some control over piston amplitude and assist in avoiding collision. However, because piston amplitude is a function of piston forces and some piston forces are a function of machine loading, and because machine loading can change, sometime rapidly, under varying operating conditions, such systems often do not permit operation at maximum amplitude of piston reciprocation because they cannot control piston amplitude with sufficient precision. Under large loading, the drive force can be very large, but the piston may not approach anywhere near a collision. However, reduction of the load can result in an increase in piston amplitude, permitting a collision to occur.

In a conventional feedback control system, including those applied to free piston machines, the control system compares a measured value with its desired value to produce an actuating error signal, which is acted upon to reduce the magnitude of the error. Referring to FIG. 1, a controlled system 10, such as the piston driver, for example a linear motor, is acted upon by a dynamic control element 12 having some preset forward transfer function. The control element 12 does the work of controlling the controlled system 10. For example, the control element 12 typically is a high gain amplifier. Historically the control element was an analog circuit, but its forward transfer control function can also be performed digitally by a microcontroller or discrete logic circuitry.

A feedback element 14, usually a sensor, applies a feedback signal to a summing junction 16 to provide the measured value. The feedback signal can be a function of piston amplitude, piston drive, piston displacement or other parameter which affects or is a function of piston amplitude.

One prior art system offering advantages in free piston machines is illustrated in U.S. Pat. No. 5,342,176, which is herein incorporated by reference. The command input 18, also referred to as the control input or reference input, provides the set point for the feedback control system and is summed with the feedback signal at the summing junction 16. This set point represents the desired value.

The command input may be a fixed quantity based upon the motor's electromechanical transfer constant and a particular stroke. Alternatively, it can be a variable controlled independently or by an external, physical phenomenon, or by a control circuit that seeks to maintain a particular value of that external phenomenon. For example, the control input can be the output of a summing junction receiving inputs derived from a sensor measuring a temperature or pressure affected by the free piston machine, or from a temperature or pressure set point. Of course, the control input may, in its simplest form, be a manually input adjustment.

The output 20 of the summing junction 16 provides an error signal, which is applied to the dynamic control element 12. The error signal is the difference between the feedback signal and the reference input signal. Of course, the summing at the summing junction 16 may be performed in the more historical manner in an analog summing circuit, or alternatively it may also be performed digitally in a microcontroller or discrete logic circuitry. As known to those skilled in the art, not only may each of these elements of the control system and their signals be performed either in an analog or digital format, but hybrid systems, which include analog to digital converters and digital to analog converters, can also be constructed which utilize some of each mode.

Consequently, the term "summing junction", as well as other control system terms, is not limited to analog circuits, but include digital implementations.

For purposes of describing the invention, the term "cylinder end structure" is used to refer to a physical body at either end of the linear path of piston reciprocation with which the piston, or structures linked to and oscillating with it, can collide if its amplitude of oscillation increases excessively. Most typically, this is a cylinder head in which valves are mounted. The term "piston drive" or "drive" is the driving force or power applied to the piston to force it in its reciprocating, linear oscillation. Since piston amplitude is an increasing function of piston drive, an increase or decrease of piston drive, respectively increases or decreases the amplitude of piston oscillation if other parameters remain constant or undergo only variations which do not completely negate the change in piston drive.

It is, therefore, an object and feature of the present invention to provide a control system for a free piston machine, which, under all operating conditions, avoids damaging or destructive collision of the piston, or component structures reciprocating with the piston, against cylinder end structures.

Another object of some embodiments of the invention is to provide a control system which not only avoids such collisions, but also reciprocates the piston near its maximum amplitude.

BRIEF SUMMARY OF THE INVENTION

The invention recognizes that initial collisions of the piston or its associated reciprocating structures against cylinder end structures, are relatively gentle and can be tolerated because they are not damaging. However, they can be tolerated only if remedial measures are immediately taken to avoid further increase in piston amplitude and to stop such collisions. Otherwise the collisions will continue with progressively greater force eventually resulting in damage to one or more of the colliding parts. The rate of amplitude increase can be high enough within a few cycles of piston oscillation to become destructive and, therefore, remedial measures must be effective in less than a few cycles.

The invention detects an initial collision and any subsequent collisions and generates a change in a perturbation signal, which is also applied to the summing junction of the control system to reduce piston amplitude a sufficient amount to stop the collisions. Consequently, the invention is principally an addition to a feedback control system and can be implemented in several embodiments.

The invention has a collision detector for detecting a collision of the piston against a cylinder end structure and generating a signal at an output in response to a detected collision. The output of the collision detector is applied to a signal generator for generating a perturbation signal, with the output of the signal generator being connected to the summing junction.

In operating according to the method of the invention, the perturbation signal is summed with the feedback signal and the reference input signal of the control system. The magnitude of the perturbation signal is varied in a direction which reduces the piston amplitude in response to detection of such a collision, and this variation continues until no collisions are detected. Some embodiments of the invention utilize a hunting system in which, whenever no collisions are detected, the perturbation signal is varied in a direction to increase piston amplitude and whenever collisions are detected, the perturbation signal is varied in a direction to reduce piston amplitude. Consequently, in such an embodiment, the piston is always reciprocating near its maximum amplitude, yet destructive collisions are always avoided.

As with conventional control systems, the structures and methods of the present invention may be operated and performed in either an analog mode or a digital mode or hybrid combinations of the two. More specifically, the perturbation signal can be an analog signal, the magnitude of which is varied, or a digital signal for which the numerical value of the data represented by the digital signal is varied. The perturbation signal generator can be either analog or it can be digital in the form of a microcomputer or discrete logic circuits and analog/digital or digital/analog converters can be used in hybrid systems.

The term "perturbation signal" is used to refer to a digital or analog signal, which is algebraically summed with one or more other signals to cause changes in the other signal. In the present invention the perturbation signal is applied to the summing junction to change its output from what it would be in the absence of the perturbation signal. In the conventional feedback control system two additional signals are applied to the summing junction, so either could be thought of as being perturbed by the perturbation signal. However, it is most convenient to think of the perturbation signal as perturbing the reference input signal, that is perturbing the set point.

Figure 1:
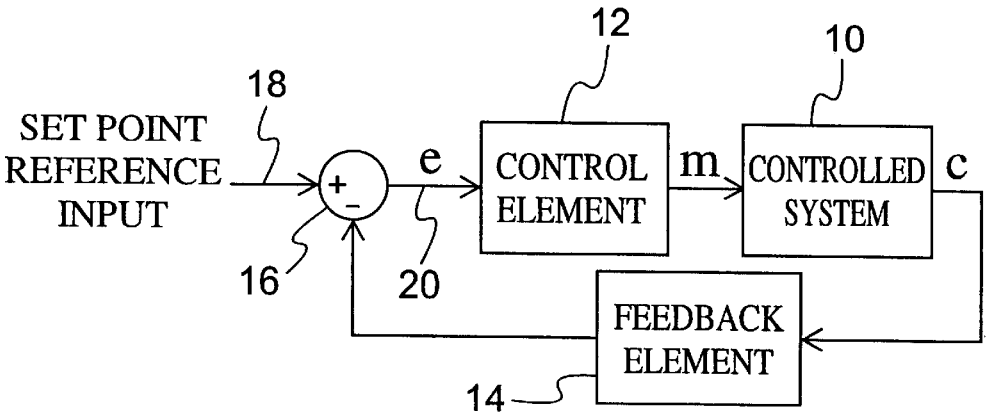
FIG. 1 (Prior Art)
FIG. 1 is a block diagram illustrating a feedback control system which is well known in the prior art.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other circuit elements where such connection is recognized as being equivalent by those skilled in the art. In addition, many circuits are illustrated which are of a type which perform well known operations on electronic signals. Those skilled in the art will recognize that there are many, and in the future may be additional, alternative circuits which are recognized as equivalent because they provide the same operations on the signals.

DETAILED DESCRIPTION OF THE INVENTION

Figure 2:
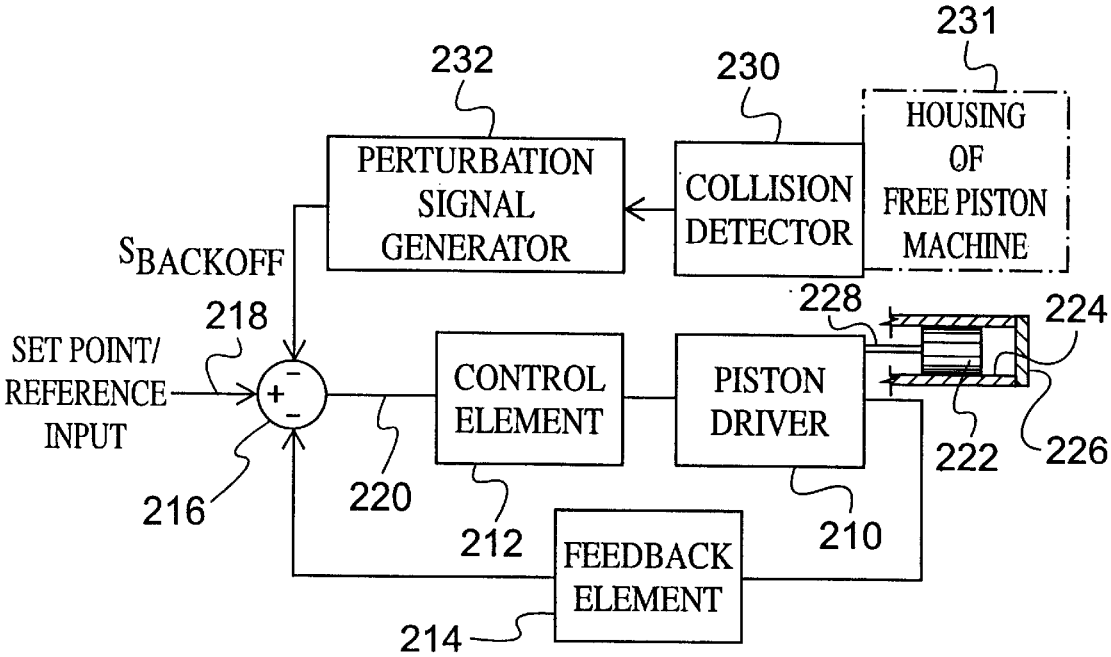
FIG. 2 is a block diagram illustrating the implementation of the present invention in association with a feedback control system for a free piston machine.

FIG. 2 illustrates a basic control system, similar to that of FIG. 1, along with improvements which comprise the invention . A piston driver 210 is controlled by a control element 212, with a feedback element 214 supplying a feedback signal from the piston driver 210, or a sensor attached to detect piston or piston driver operation, to a summing junction 216 in the conventional manner. The piston driver is, of course, mechanically linked to a piston 222 for driving it. The piston 222 is slidably mounted within a cylinder 224, having a head 226 forming a cylinder end structure and connected to the piston driver by a connecting link 228. The set point is applied at the reference input 218 in the conventional manner. The preferred prior art control system is that illustrated in U.S. Pat. No. 5,342,176.

The invention has a collision detector 230 for detecting a collision of the piston, including structures attached to and reciprocating with it, against a cylinder end structure. The output of the collision detector 230 is applied to a perturbation signal generator 232, which in turn has its output, $S_{BACKOFF}$, connected to the summing junction 216.

As will be described and illustrated in more detail below, the preferred collision detector employs a microphone or other device which is physically linked to the housing 231 of the free piston machine for detecting mechanical vibration energy. Its output signal is applied to a filter, the output of which is connected to a comparator. The filter has a pass band over a frequency range which is characteristic of the collisions which can occur in the free piston machine. Consequently, each machine may be pretested to determine the frequency range which is characteristic of its collisions. The filter filters out vibratory energy resulting from normal machine operation outside its passband and passes vibratory energy only in the band in which the collision-induced frequencies occur. The output of the filter is applied to one input of a comparator, the other input being a reference level. The reference level is set to represent the normal vibratory energy in the passband during normal operation. When vibratory energy in that passband exceeds the vibratory energy during normal operation, the output of the comparator switches states, thereby generating a signal at its output in response to a detected collision.

The prior art illustrates a variety of velocity and acceleration detectors for free piston machines. These too can be employed for detecting collisions and may be used for the collision detector 230. Velocity and acceleration detectors detect collision by detecting a high rate of piston deceleration, which exceeds piston deceleration during normal machine operation in the absence of a collision.

As another alternative collision detector, a limit switch may be used by physically mounting the limit switch near a cylinder end structure, so that movement of the switch by contact with the piston, or structure reciprocating with the piston, changes the state of the switch and signals a collision at the permissible limits of piston reciprocation. It will be apparent to those skilled in the art that proximity switches and a variety of other means may be used to detect a collision.

Figure 3:
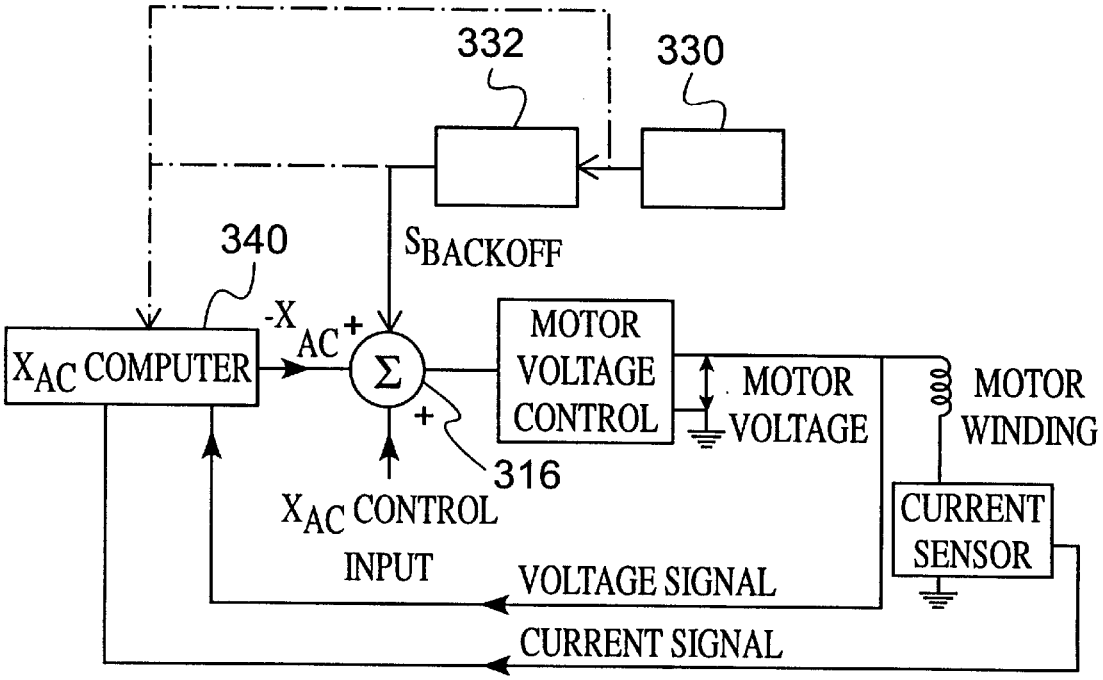
FIG. 3 is a block diagram illustrating an implementation of the invention utilizing the preferred feedback control system.

FIG. 3 illustrates a collision detector 330 applying its signal to a perturbation signal generator 332, the output of which is applied to the summing junction 316 of the preferred control system illustrated in U.S. Pat. No. 5,342,176. However, since the preferred control system utilizes a microcontroller 340, the output of the perturbation signal generator 342 may alternatively be applied to the microcontroller 340 with the summing of the perturbation signal $S_{backoff}$ being performed digitally within the microcontroller 340. Alternatively, the output of the collision detector 330 may be applied directly from the collision detector 330 to the microcontroller 340 with the perturbation signal generating function being performed by the microcontroller 340. The collision detector output may simply be a two-state digital signal, one state representing the detection of a collision and the other state representing the absence of a collision. In this manner, the perturbation signal generator is itself a part of the programmed microcontroller 340. As yet another alternative, the microphone or deceleration detector signal can be sampled and converted to digital form and signal analysis algorithms used to detect a collision.

Figure 4:
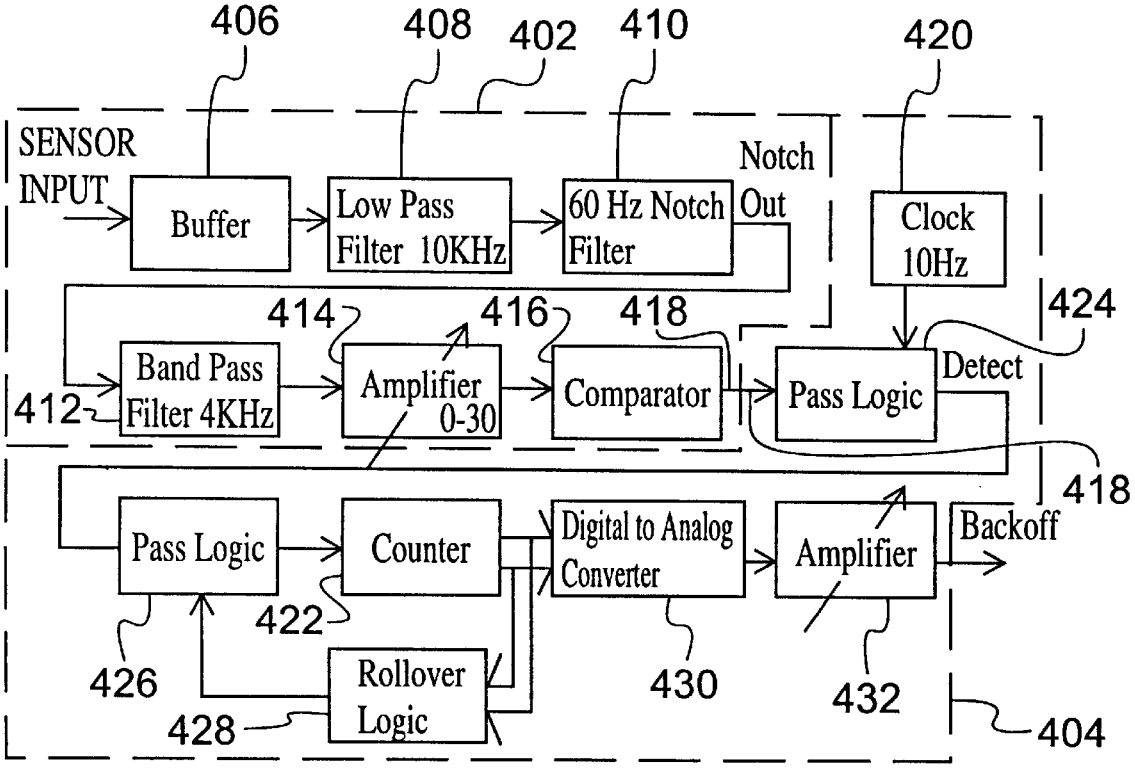
FIG. 4 is a block diagram illustrating an implementation of the collision detector and perturbation signal generator of the present invention, which is capable of reducing piston amplitude in response to detection of collisions.

The circuit of FIG. 4 is implemented for a free piston machine in which pretesting determined that the frequencies which are characteristic of collisions occur around 4 kHz. FIG. 4 illustrates a collision detector circuit 402 and a perturbation signal generator 404 for generating the perturbation signal to be applied to the summing junction, in the manner described above. The collision detector includes a microphone-type sensor, the output of which is applied to a series of filter stages, an amplifier and then a comparator. The comparator output is applied to a digital logic circuit. More particularly, the output from the microphone is applied to a buffer 406, which is a very wide, bandpass filter principally for removing from the microphone signal any DC components but conveniently also removing any high frequency noise and interference. The output from the buffer 406 is applied to a low pass filter 408, for example having a cut-off frequency at 10 kHz. The purpose of this filter is to attenuate extraneous, high frequency noise, such as switching noise from a 20 kHz, pulse width modulated motor drive. The low pass filter 408 is followed by a 60 Hz notch filter 410 for purposes of removing 60 Hz signals, which will be large when the machine is typically operated at 60 Hz. Finally, the output of the notch filter 410 is applied to a bandpass filter 412, in the example embodiment having a center frequency at 4 kHz and a quality factor Q of about 3. Its purpose is to pass the frequency band in which collision-induced vibratory energy occurs. The output of the bandpass filter 412 is applied to an adjustable gain amplifier 414.

The output of the amplifier 414 is therefore an AC signal having is energy in the passband that is characteristic of collisions. It is applied to a peak detector, which can be a conventional peak detector formed by a diode followed by an RC network. A capacitor charges quickly through the diode, but discharges slowly with a 33 msec time constant through the associated resistor. Consequently, a voltage is applied by the peak detector to one end of the comparator 416. That voltage represents the peak amplitude of the sensed, filtered and amplified vibration signal within the passband that is characteristic of collisions.

The comparator also includes a reference input signal which is adjusted to a level so that the comparator output 418 will have one state when the peak representing the vibratory energy in the collision inducing passband is the maximum experienced during normal operation in the absence of collisions and to switch to a second state when the peak exceeds that level.

A 10 Hz clock 420 provides clock pulses which are passed to a digital counter 422 when the comparator output 418 represents the detection of collisions and which are not passed to the counter 422 in the absence of collisions. To accomplish that operation, the output of the comparator 418 is applied to a pass logic circuit 424, which acts as a gate, passing clock pulses as described above.

The pass logic circuit 426 also operates as a data gate, controlled by a rollover logic circuit 428. The rollover logic circuit 428 simply opens the pass logic circuit 426 to prevent further clock pulses from passing to the counter 422 whenever the counter 422 has incremented to its maximum value. Its purpose is to prevent the counter 422 from rolling over from its highest value to its lowest value.

The output of the counter 422 is applied to a digital to analog converter 430, which converts the digital count to an analog voltage level having a magnitude corresponding to the count in the digital counter 422. Consequently, as the counter is incremented by pulses from the clock 420 while collisions are detected, the magnitude of the voltage output from the digital to analog converter 430 is increased to cause an increase in the perturbation signal. For example, it may change at a rate of 0.3 volts per second. Preferably, the output of the digital to analog converter is applied to an adjustable gain amplifier 432 to permit calibration of the machine. During time intervals when collisions are absent, the magnitude of the perturbation signal is held constant at the value it acquired when the last collision was detected.

Figure 5:
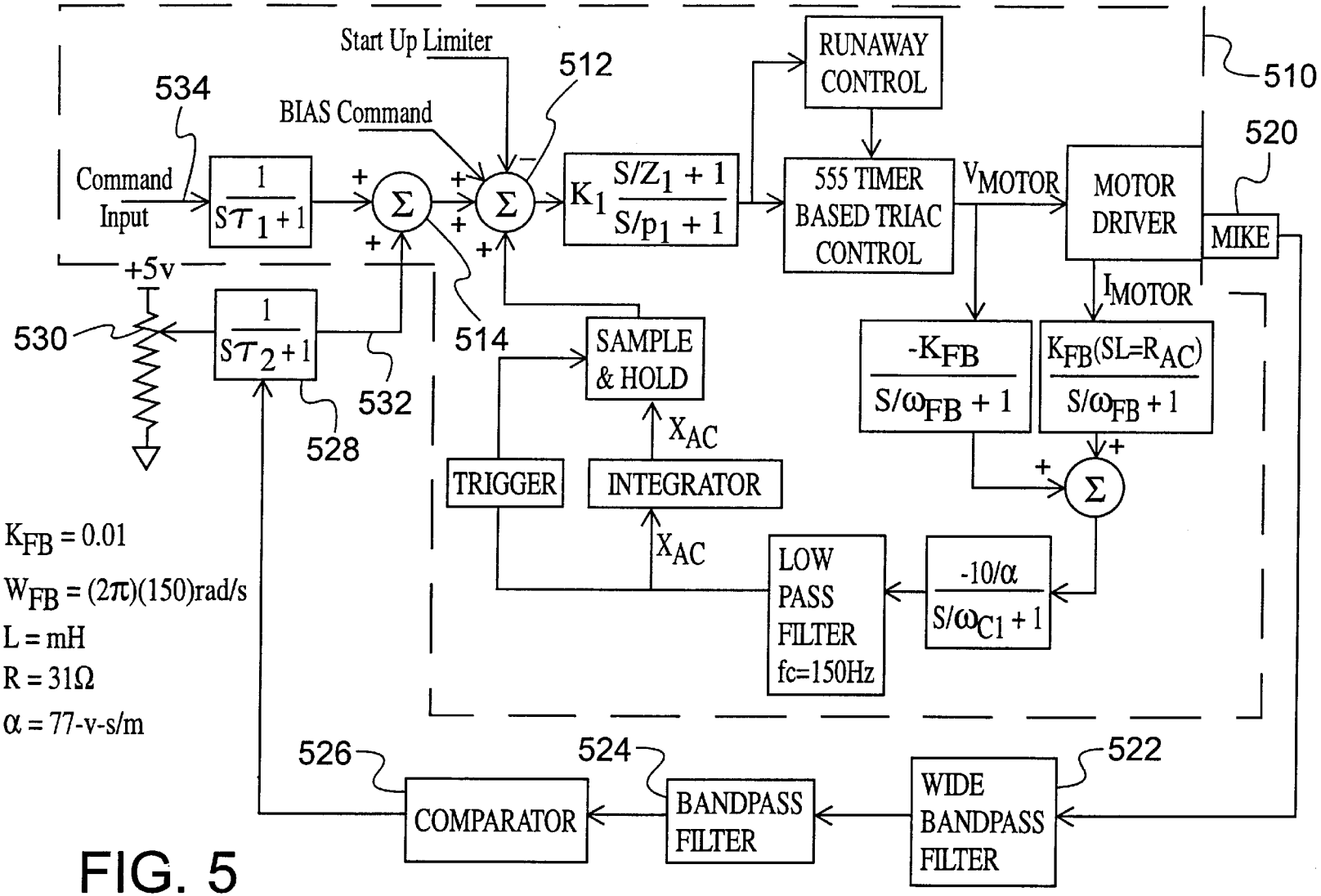
FIG. 5 is a block diagram of an embodiment of the invention which is capable of both increasing the piston amplitude in response to the absence of the detection of collisions and decreasing the piston amplitude in response to the detection of collisions.

The circuit illustrated in FIG. 5 includes within dashed lines 510 a more detailed block diagram of an implementation of the control system illustrated in U.S. Pat. No. 5,342,176. Because the invention does not reside within the details of this negative feedback control system 510 and because the labeling on the blocks of that control system 510 make its operation apparent to a person of ordinary skill in the control art, the control system 510 is not described further. For ease of understanding, the summing junction is depicted as a pair of summing junctions 512 and 514 with the summed inputs to junction 514 being summed with the inputs to junction 512, thereby making the pair of summing junctions 512 and 514 identical to a single summing junction to which all inputs are applied and summed.

Like the circuit of FIG. 4, the circuit of FIG. 5 sums a perturbation signal with the feedback signal and the reference input signal, detects a collision of the piston against a cylinder end structure and generates a signal at an output in response to a detected collision. The circuit then varies the magnitude of the perturbation signal in the direction which reduces the piston drive in response to each detection of a collision. However, the circuit of FIG. 5 additionally varies the magnitude of the perturbation signal in a direction which increases the piston drive in response to the absence of detection of a collision. Consequently, the system of FIG. 5 hunts by oscillating in a triangular waveform fashion between a piston amplitude of oscillation at which initial collisions are detected and a slightly lesser value of piston amplitude at which collisions are not detected. This maintains piston amplitude near its maximum.

A microphone 520 is connected to output its detected vibratory energy to a wide bandpass filter 522, which is like the wide bandpass filter 406 of FIG. 4. The output of the wide bandpass filter 522 is applied to a bandpass filter 524 with its passband centered in the band in which collision vibratory energy is generated by collision and is like the bandpass filter 412 of FIG. 4. The comparator 526 receives the output of the bandpass filter 524 and operates in the same manner as the comparator 416, described in connection with FIG. 4. The output of the comparator 526 has two levels and is applied to a time constant circuit 528. The time constant circuit 528 is connected to a potentiometer 530, which forms a voltage divider to which, for example, five volts is applied. The time constant circuit 528 is an RC network switched by a transistor so that in one state of the output of comparator 526, when a collision is not detected, the output 532 of the time constant circuit 528 ramps up at a time constant $\tau_2$ toward a proportion of five volts determined by the setting of the potentiometer 530. This, therefore, applies from the output 532 to the summing junction 514, an increasing voltage ramp so long as the output of the comparator 526 remains in the same state. This increase has the same effect as increasing the command input 534 and consequently increases piston amplitude until either the comparator output changes state or the voltage at output 532 ramps up to the maximum charge on the capacitor of the RC circuit.

When a collision is detected, the output of comparator 526 switches to its other state and the voltage at output 532 ramps downwardly toward zero. It continues ramping downwardly, when a collision is detected, until the output of comparator 526 changes state as a result of the absence of detected collisions. Therefore, in a steady state operation the hunting occurs by the output of 532, ramping upwardly to increase piston amplitude whenever a collision is not detected and ramping downwardly to reduce piston amplitude whenever a collision is detected.

Figure 6:
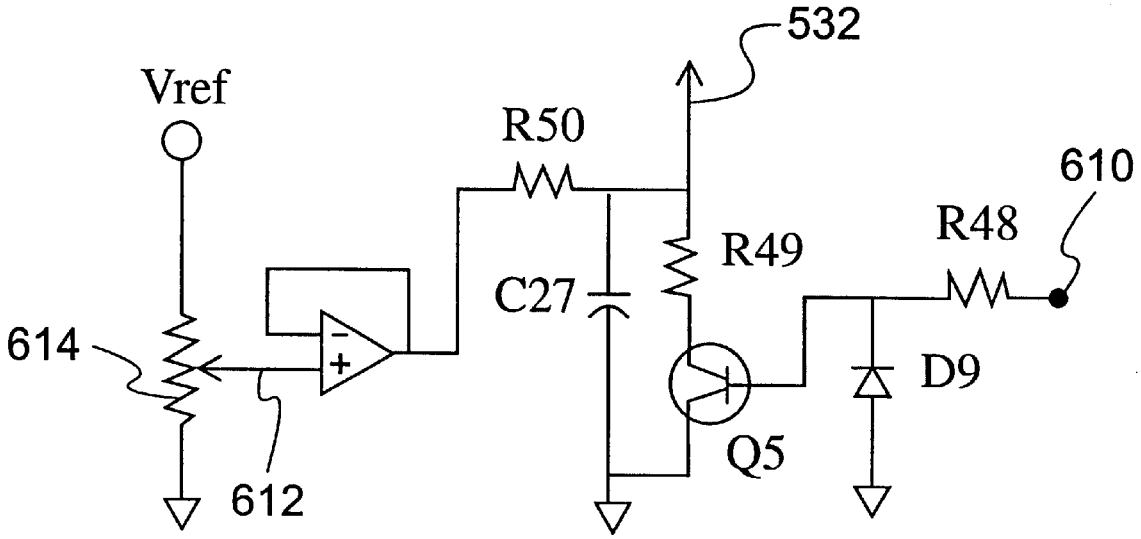
FIG. 6 is a schematic circuit diagram of an example of a perturbation signal generator.

FIG. 6 illustrates a circuit for accomplishing this purpose. The output of the comparator 526 of FIG. 5 is applied to input terminal 610 in FIG. 6. This input controls transistor Q5. When the voltage applied at terminal 610 turns off transistor Q5, capacitor C27 charges toward the voltage of the wiper 612 of potentiometer 614 at a rate determined by the resistance of resistor R50 and the upper portion of potentiometer 614. When the output of the comparator 526 changes states so that the voltage applied at input terminal 610 switches transistor Q5 on, the capacitor C27 is discharged at a rate determined by the RC time constant of C27 and resistor R49. The voltage on the capacitor is the output 532 of the time constant circuit 528 illustrated in FIG. 5.

The rate of change of the magnitude of the perturbation signal in each direction is determined essentially by the respective time constants for charging and discharging the capacitor C27. This permits the resistance and capacitance values to be chosen respectively so that the rate of change for varying the magnitude of the perturbation signal in a direction which reduces the piston drive in response to detection of a collision may be greater, including considerably greater, than the rate in the absence of detection of a collision. This is desirable so that when a collision is detected, the piston amplitude is rapidly decreased in order to avoid damage. However, the increase of piston amplitude in the absence of collision detection may be considerably slower in order to minimize the occurrence of collisions and yet maintain the piston amplitude near its maximum value.

One useful application of the invention is in free piston Stirling coolers and free piston linear compressors. In free piston linear compressors and Stirling coolers, the error signal drives the linear motor that applies mechanical power to the compressor or Stirling cooler. In a free piston Stirling engine, the error signal drives an automatic control device that adjusts the coupling between the engine's piston and displacer and the error signal may additionally drive a second automatic control device governing the rate at which heat is applied to the engine.

In free piston Stirling coolers, the amplitude of displacer reciprocation resulting from a given driving force and piston amplitude varies in reverse proportion to the temperature difference across the cold finger. Thus, a driving force and piston stroke that produces a permissible displacer amplitude when the temperature of the tip of the cold finger is far below ambient temperature can cause a destructively excessive displacer amplitude while the tip is near to ambient temperature. In some applications, it is desirable to minimize the amount of time required for the temperature of the tip of the cold finger to cool down from ambient temperature to its steady state operating temperature. This cool-down time is minimized when the amplitude of motion of the displacer sweeps out the entire geometric space available for reciprocation during every cycle.

Another useful application of the invention is in free piston machines in which a linear alternator is driven by a free piston Stirling engine. Power piston collisions may occur if, for example, alterations in the alternator's electromechanical transfer constant occur, as may happen if the alternator's magnets are partly demagnetized during service. The present invention can detect the resulting collisions early, before they become destructive and then make appropriate adjustments to an automatic power control device to quickly reduce the amplitude of internal reciprocating bodies and/or reduce the amount of thermal energy being supplied to the machine.

A variety of additional embodiments, applications and implementations of the principles of the present invention are possible. As a general principle, piston motion, including piston amplitude and average piston position (the center of oscillation), is the result of the sum of the forces being applied to the piston. These may be referred to as piston forces. Many piston forces affect piston motion. These include piston drive forces, including the heat transferred to a free piston Stirling engine, damping forces, inertia forces, forces from loading, such as power supplied to a load by an alternator driven by a free piston Stirling engine, and spring forces, including gas pressure forces within a free piston Stirling engine. All of these piston forces affect piston motion.

These piston forces are typically controlled somewhat indirectly by a negative feedback control system, for example by controlling the voltage applied to a linear motor driving a free piston, controlling the voltage output of a linear alternator, controlling the temperature of a cryocooler, or controlling the rate of transfer of thermal energy into and out of a free piston Stirling engine in order to cause the working gas to expand and contract and thereby drive the engine. Sometimes a machine parameter, such as its power output, is controlled by controlling the forces between interacting machine components. Consequently, the term "controlling a piston force" includes, and usually means, controlling a parameter of a machine which in turn affects or is affected by a piston force and therefore affects piston motion.

Because each of these piston forces affects piston amplitude (i.e. piston amplitude is a function of each of them) or average piston position, any one or more of these piston forces can be controlled by a negative feedback control system. Therefore, the perturbation signal of the present invention can be applied to any of those feedback control systems, although obviously control of inertia is less practical.

In addition to utilizing the present invention for controlling and varying the piston drive, such as in a compressor driven by a linear motor, as described above, there are additional examples of practical feedback control systems for a free piston engine in which the present invention can be implemented.

The heat input to a free piston Stirling engine can be controlled by a negative feedback control system, to which the perturbation signal of the present invention may be applied. For example, the orifice of a gas valve controlling a burner may be adjusted by a feedback control system to which the perturbation signal is applied. However, because of the slow response time of practical free piston Stirling engines, additional collision protection is necessary. The present invention may be applied, however, for long time constant heat input control.

As another practical example, the load driven by a free piston Stirling engine may be adjusted to vary the piston forces in a direction to reduce piston amplitude and prevent collisions when collisions are detected. For example, for a linear alternator driven by a free piston Stirling engine, a variable resistance load may be connected to the linear alternator and a feedback control system used to control output voltage. As a third practical example, a free piston Stirling engine typically includes controls for controlling its operation, including controlling piston forces. Such controls include controlling the spring constant of a variable gas spring which couples the engine's power piston to its displacer as illustrated in U.S. Pat. No. 5,385,021 which is herein incorporated by reference. Another control for a free piston engine or cooler is the adjustable coupling between the power piston and the displacer illustrated in U.S. Pat. No. 5,502,968 which is herein incorporated by reference. These and other controls for a free piston machine may also be controlled by a negative feedback control system to which the perturbation signal of the present invention can be applied.

Figure 7:
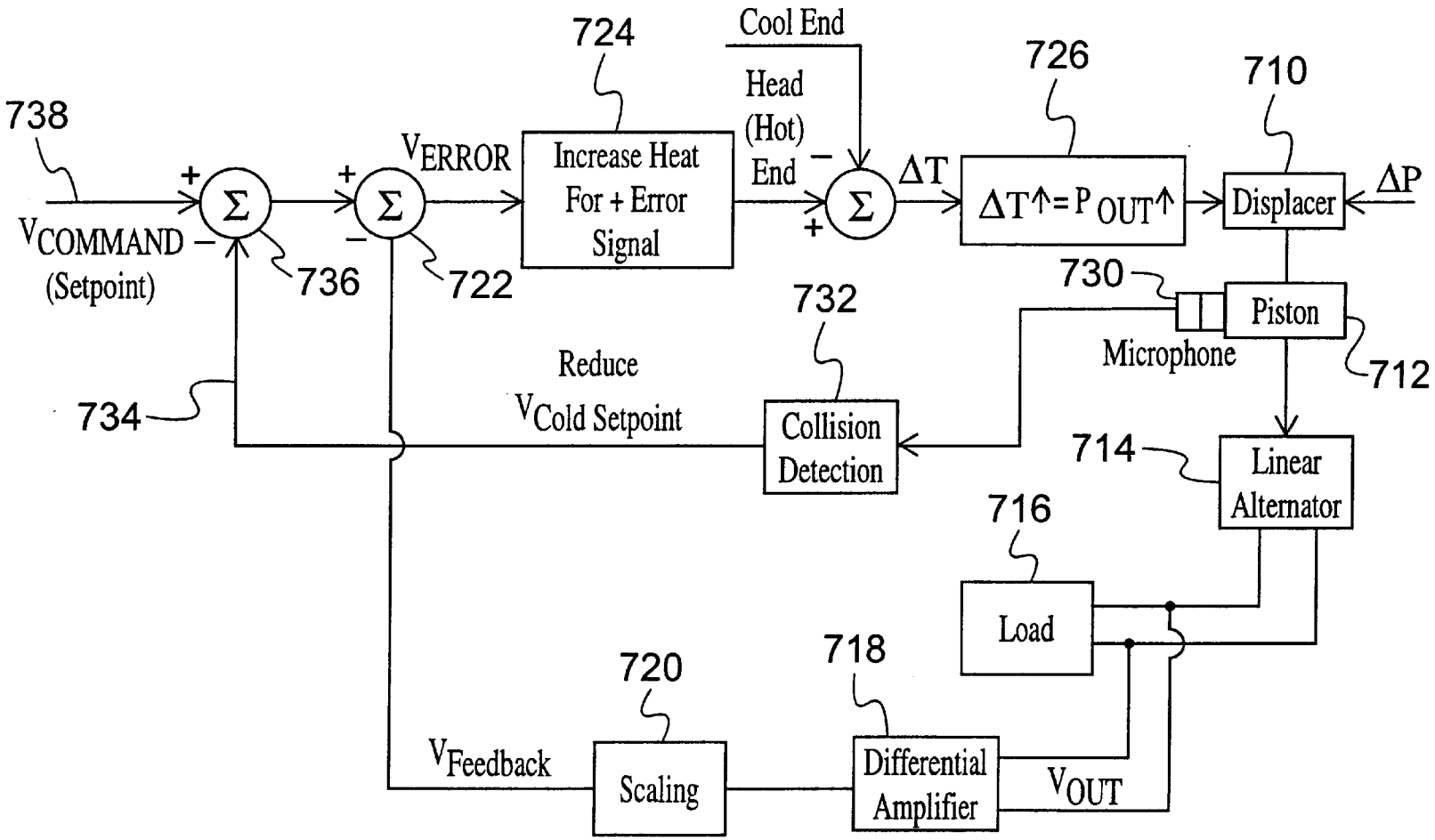
FIGS. 7 through 9 are block diagrams illustrating alternative applications of the present invention.
Figure 8:
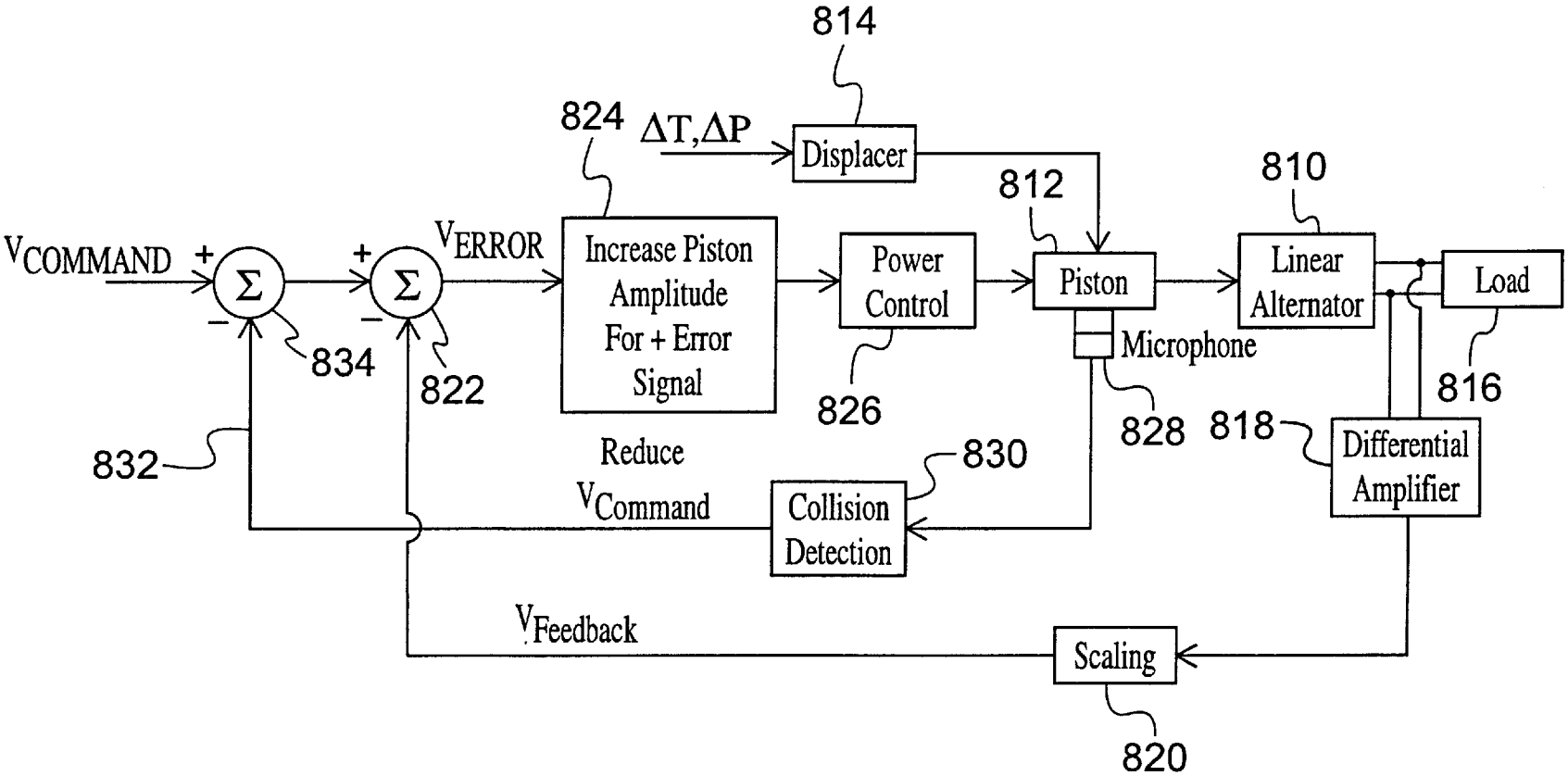
Figure 9:
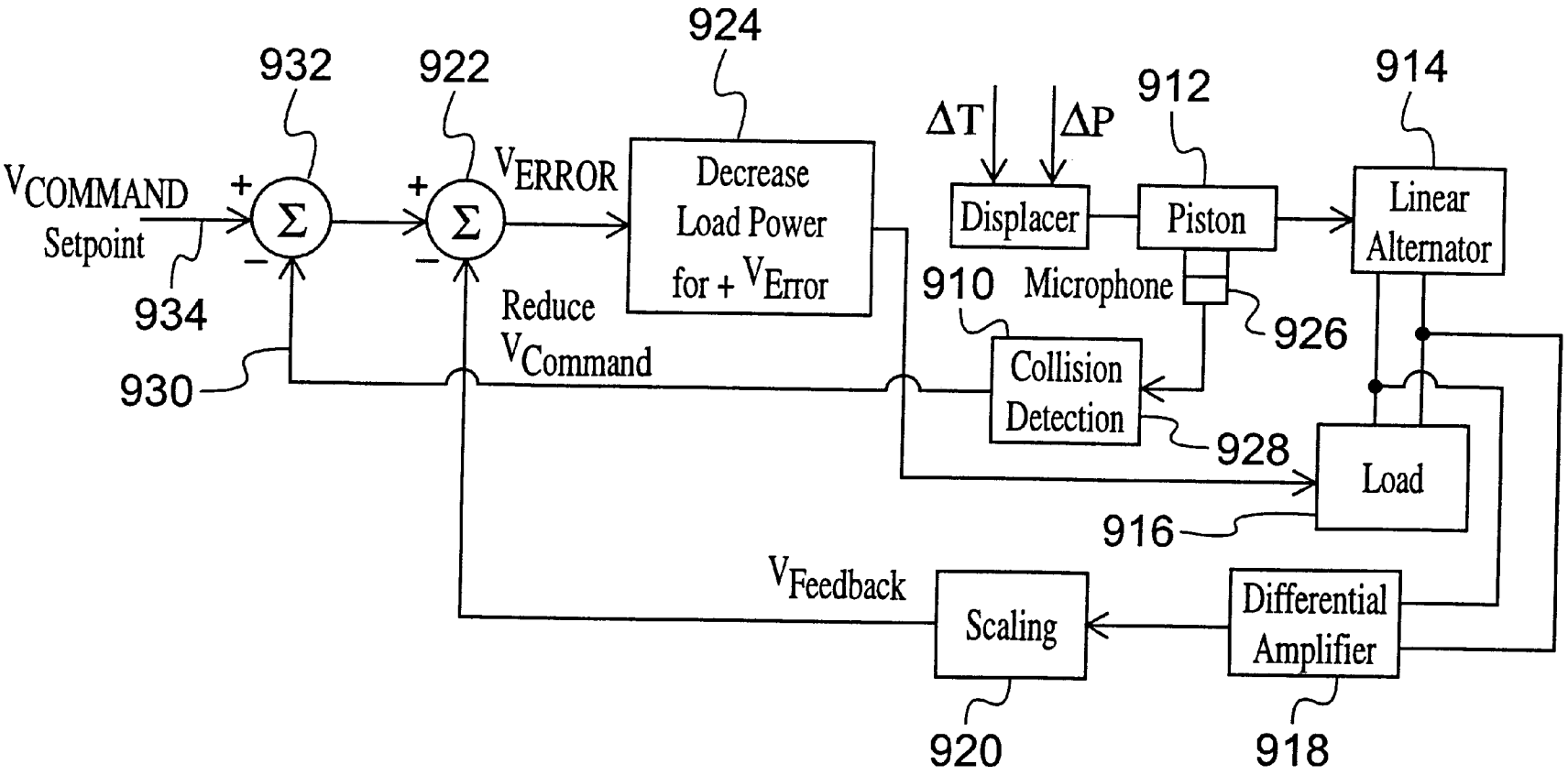

Examples of these three control systems are illustrated in FIGS. 7, 8 and 9. FIG. 7 illustrates a conventional negative feedback control system for controlling a free piston Stirling engine having a displacer 710 and a power piston 712, which is mechanically linked to drive a linear alternator 714, which in turn is electrically connected to an electrical load 716. The load voltage $V_{out}$ is sensed, amplified by differential amplifier 718, scaled by scaling circuit 720 and applied as the feedback signal to summing junction 722. The error signal is applied to a control element 724 for controlling an apparatus 726 which controls the heat applied to the hot head end of the free piston Stirling engine, thereby controlling its power output. It may, for example, be controlling an adjustable valve of a gas burner. As illustrated in the preceding embodiments, a microphone 730 is mounted to the housing of the free piston Stirling engine for detecting piston collisions and its output is applied to collision detection circuitry 732 embodying the invention, as described above. Its output applies a perturbation signal to input 734 of the summing junction 736 so that it may be summed with both the command input 738 and the feedback signal applied from the scaling circuit 720 to the summing junction 722.

FIG. 8 illustrates a negative feedback control system used to control the voltage output of a linear alternator 810, which is driven by a free piston Stirling engine having a power piston 812, mechanically driving the linear alternator 810 and having a displacer 814. The output of the linear alternator 810 is electrically connected to an electrical load 816, the voltage of which is amplified by differential amplifier 818 and scaled by scaling circuit 820. The output of the scaling circuit 820 is applied as the feedback signal to the summing junction 822. The error signal is applied to a control element 824 that controls the power control 826 for the free piston Stirling engine, such as the controls referenced above. As with preferred embodiments previously described, a microphone 828 is connected to collision detection circuitry 830 embodying the present invention, the output of which is the perturbation signal applied at input 832 to summing junction 834.

FIG. 9 illustrates a free piston Stirling engine having a displacer 910 and power piston 912 mechanically driving a linear alternator 914, which is electrically connected to an adjustable electrical load 916. The linear alternator output is, at times, additionally connected to an external load for doing useful work, such as electrical lighting. The voltage applied by the linear alternator to the adjustable load 916 is amplified by the differential amplifier 918, scaled by scaling circuit 920 and applied as the feedback signal to the summing junction 922. The control element 924 controls the resistance of the adjustable load 916 in the usual manner of a feedback control system. A microphone 926 has its output connected to collision detection circuitry 928 of the present invention, such as described above, to apply the perturbation signal at input terminal 930 of the summing junction 932 to which the command input 934 is also applied.

While certain preferred embodiments of the present invention have been disclosed in detail, it is to be understood that various modifications may be adopted without departing from the spirit of the invention or scope of the following claims.

What is claimed is:

1. An improved control system for a free piston machine, having a piston reciprocating in linear oscillation within a cylinder, the cylinder having at least one cylinder end structure, the machine also having a negative feedback control system controlling a piston force, the control system including a summing junction to which a feedback signal and a control input signal are applied for deriving an error signal, wherein the improvement comprises:

(a) a collision detector for detecting a collision of the piston against the cylinder end structure and generating a signal at an output in response to a detected collision;

(b) a signal generator for generating a perturbation signal and having its input connected to the output of the collision detector and its output connected to the summing junction.

2. A control system in accordance with claim 1 wherein the collision detector comprises a mechanical vibration detector.

3. A control system in accordance with claim 2 wherein the mechanical vibration detector comprises a microphone.

4. A control system in accordance with claim 2 and further comprising:

(a) a passband filter circuit connecting to receive the output of the mechanical vibration detector and passing frequencies which are characteristic of collisions; and (b) a comparator having a reference input and connected to receive the output of the filter circuit, for changing states in response to the magnitude of the signals passing the filter circuit exceeding a preselected value of the comparator reference input.

5. A control system in accordance with claim 1 wherein the collision detector comprises an acceleration detector linked to the piston for detecting piston acceleration.

6. A control system in accordance with claim 1 wherein the collision detector comprises a velocity detector linked to the piston for detecting piston velocity.

7. A control system in accordance with claim 1 wherein the collision detector comprises a limit switch.

8. A control system in accordance with claim 1 wherein the perturbation signal generator comprises a digital logic circuit, including a counter circuit and a digital to analog converter circuit connected to receive the output of the counter circuit for switching the count of the counter circuit in response to a detected collision.

9. A control system in accordance with claim 1 wherein the perturbation signal generator comprises a programmed microcontroller.

10. A method for preventing destructive collisions in a free piston machine having a piston reciprocating in linear oscillation within a cylinder, the cylinder having at least one cylinder end structure, the machine also having a negative feedback control system controlling a piston force, the control system summing a feedback signal and a reference input signal and deriving an error difference signal, the method comprising:

(a) summing a perturbation signal with the feedback signal and the reference input signal;

(b) detecting a collision of the piston against the cylinder end structure and generating a signal at an output in response to a detected collision; and (c) varying the magnitude of the perturbation signal in a direction which reduces piston amplitude in response to each detection of a collision.

11. A method in accordance with claim 10 and further comprising: varying the magnitude of the perturbation signal in a direction which increases the piston amplitude in response to the absence of detection of a collision.

12. A method in accordance with claim 11 wherein the magnitude of the perturbation signal is varied in each direction at a respective constant time rate of change.

13. A method in accordance with claim 12 where the rate of change for varying the magnitude of the perturbation signal in a direction which reduces the piston amplitude in response to each detection of a collision is greater than the rate of change for varying the magnitude of the perturbation signal in a direction which increases the piston amplitude in response to the absence of detection of a collision.

14. A method in accordance with claim 10 wherein a collision is detected by detecting the presence of a magnitude increase of mechanical vibration energy at a frequency which is characteristic of collisions above the magnitude in the absence of a collision.

15. A method in accordance with claim 10 wherein a collision is detected by detecting a high rate of piston deceleration which exceeds piston deceleration in the absence of a collision.

16. An apparatus for preventing destructive collisions in a free piston machine having a piston reciprocating in linear oscillation within a cylinder, the cylinder having at least one cylinder end structure, the machine also having a negative feedback control system controlling a piston force, the control system summing a feedback signal and a reference input signal and deriving an error difference signal, the apparatus comprising:

(a) means for summing a perturbation signal with the feedback signal and the reference input signal;

(b) means for detecting a collision of the piston against the cylinder end structure and generating a signal at an output in response to a detected collision; and (c) means for varying the magnitude of the perturbation signal in a direction which reduces the piston amplitude in response to each detection of a collision.

17. A apparatus in accordance with claim 16 and further comprising: said means for varying the magnitude of the perturbation signal also varies the magnitude in a direction which increases the piston amplitude in response to the absence of detection of a collision.

18. An apparatus for detecting collisions in a free piston machine, the collisions generating mechanical vibrations in a characteristic frequency range, the apparatus comprising:

(a) a mechanical vibration detector having an output for an electrical signal representing a detected mechanical vibration;

(b) a filter connected to the output of the vibration detector and having a passband at the characteristic frequency range; and (c) means for comparing the magnitude of the output from the filter to a reference representing the output of the filter in the absence of collisions and having an output for changing in response to the filter output exceeding the reference and thereby signaling the detection of a collision.

19. A control system in accordance with claim 18 wherein the mechanical vibration detector comprises a microphone.

20. A method for detecting collisions in a free piston machine, the collisions generating mechanical vibrations in a characteristic frequency range, the method comprising:

(a) detecting mechanical vibrations of the machine by generating an electrical signal representing the detected vibrations;

(b) filtering the detected mechanical vibration signal by passing the characteristic frequency range; and (c) comparing the magnitude of the filtered signal to a reference representing the filtered signal in the absence of collisions and signaling the detection of a collision in response to a filtered signal exceeding the reference.

* * * * *